US009335671B2

(12) United States Patent
Kudo

(10) Patent No.: US 9,335,671 B2
(45) Date of Patent: May 10, 2016

(54) BELT UNIT HAVING STEERING ROLLER TO CORRECT POSITION OF BELT AND IMAGE FORMING APPARATUS INCLUDING THE SAME

(71) Applicant: CANON KABUSHIKI KAISHA, Tokyo (JP)

(72) Inventor: Ran Kudo, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/720,542

(22) Filed: May 22, 2015

(65) Prior Publication Data

US 2015/0346648 A1 Dec. 3, 2015

(30) Foreign Application Priority Data

May 27, 2014 (JP) ..... 2014-109578

(51) Int. Cl.
*G03G 15/16* (2006.01)

(52) U.S. Cl.
CPC .. *G03G 15/1615* (2013.01); *G03G 2215/00156* (2013.01); *G03G 2215/0132* (2013.01)

(58) Field of Classification Search
CPC ..... G03G 15/161; G03G 15/1615; G03G 2215/00143; G03G 2215/00151; G03G 2215/00168
USPC ..... 399/121, 165, 302, 303
See application file for complete search history.

(56) References Cited

U.S. PATENT DOCUMENTS

| | | | | |
|---|---|---|---|---|
| 8,335,461 | B2 * | 12/2012 | Yasumoto | G03G 15/0131 399/302 |
| 8,346,140 | B2 * | 1/2013 | Yasumoto | G03G 15/0131 399/302 |
| 8,837,989 | B2 * | 9/2014 | Yasumoto | G03G 15/161 399/302 |
| 8,971,761 | B2 * | 3/2015 | Yuasa | G03G 15/0189 399/121 |

FOREIGN PATENT DOCUMENTS

| | | | |
|---|---|---|---|
| JP | 4-317936 | A | 11/1992 |
| JP | 9-169449 | A | 6/1997 |
| JP | 2001-146335 | A | 5/2001 |
| JP | 2001-520611 | A | 10/2001 |
| JP | 2003-192114 | A | 7/2003 |
| JP | 2011-48082 | A | 3/2011 |

* cited by examiner

*Primary Examiner* — William J Royer
(74) *Attorney, Agent, or Firm* — Canon U.S.A., Inc. IP Division

(57) ABSTRACT

A belt unit including a steering mechanism employing a belt auto alignment method includes a restricting portion configured to enable a steering roller to rotate about a steering axis line for correcting the deviation of the position of the belt in the width-wise direction, while restricting the inclination of the steering roller due to the rotation.

9 Claims, 9 Drawing Sheets

-- Prior Art --

BELT UNIT HAVING STEERING ROLLER TO CORRECT POSITION OF BELT AND IMAGE FORMING APPARATUS INCLUDING THE SAME

BACKGROUND OF THE INVENTION

1. Field of the Invention

The present invention relates to a belt unit used in an image forming apparatus such as a copying machine, a printer, and a FAX machine employing an electrophotographic method or an electrostatic recording method, and to an image forming apparatus including the belt unit.

2. Description of the Related Art

In conventional image forming apparatuses employing an electrophotographic method and the like, an endless belt stretched between a plurality of support rollers, has been used as an intermediate transfer member, a recording material bearing member, or the like. A toner image is transferred from a photosensitive member onto the intermediate transfer member. The recording material bearing member carries and conveys a recording material onto which the toner image is transferred from the photosensitive member. Such a belt has a problem of belt deviation where the drivingly rotated belt is deviated in a direction toward any one of the end portions in a width-wise direction depending on an accuracy of the outer diameters of the rollers, an accuracy of alignment between the rollers, or the like.

Japanese Patent Application Laid-Open No. H9-169449 discusses a configuration of detecting the belt deviation with a sensor and controlling an inclination of a steering roller with an actuator, as a unit for correcting the belt deviation. Japanese Patent Application Laid-Open No. 2001-146335 discusses a configuration in which belt deviation restricting portion members that engage with a rib formed on a back surface of a belt are disposed on both end portions of a support roller. Japanese Translation of PCT Application No. 2001-520611 discusses a method of automatically aligning a belt with a steering roller based on friction force balance (hereinafter, referred to as "belt auto alignment method"), as a method of controlling the belt deviation easily at low cost and with a small number of components.

The configuration in Japanese Translation of PCT Application No. 2001-520611 includes a steering mechanism as illustrated in FIG. 9 of the present application. More specifically, the steering mechanism includes a steering roller 90 that can rotate by being driven by the rotation of a belt and both end members 91 that are disposed at both end portions of the steering roller 90 and cannot be driven by the rotation of the belt. The steering roller 90 is supported by a supporting base 92 that can rotate in a direction indicated by an arrow S about a steering shaft 93 disposed in a center portion. The supporting base 92 is biased in a direction indicated by an arrow $P_T$ by a tension applying unit 95 that is compressed by a pressure release cam 96. As a result, an outer circumference surface of the steering roller 90 applies a tension to an inner circumference surface of the belt (not illustrated).

The belt auto alignment method can achieve a simpler configuration than the method of controlling the inclination of the steering roller with the sensor and the actuator, and can achieve smaller degradation such as wearing of components than the method in which the rib of the belt comes into contact with the belt deviation restricting member. All things considered, the belt auto alignment method advantageously facilitates an attempt to reduce an apparatus cost.

When the belt unit is attached to or detached from the apparatus main body of the image forming apparatus, the tension applied to the belt might be reduced. The steering mechanism in the belt auto alignment method is inclined by means of the movement force of the belt. Thus, the steering roller is likely to incline when the tension applied to the belt is reduced. When the belt unit is attached to or detached from the apparatus main body in this state, the steering mechanism might come into contact with another member in the apparatus main body such as a photosensitive member, and thus the other member might be damaged by abrasion or the like.

In the steering mechanism in Japanese Translation of PCT Application No. 2001-520611, springs 98 serving as a rotation stopping unit for the steering mechanism are disposed at both end portions of a steering roller 90 in an axial direction. In this configuration, the tension applied to the belt might be relatively low not only for attaching or detaching the belt unit but also due to settings for image forming or for achieving a configuration of separating a roller, which comes into contact with the photosensitive member with a belt interposed in between, from the photosensitive member. In such a case, with the configuration in Japanese Translation of PCT Application No. 2001-520611, the force of the springs 98 might be relatively too strong and thus the belt auto alignment based on friction force balance might become ineffective. On the other hand, when the force of the springs 98 is set to be low, the steering mechanism is likely to incline. Thus, as in the case described above, when the belt unit is attached to or detached from the apparatus main body, the steering roller might come into contact with the photosensitive member and the like in the apparatus main body and thus the photosensitive member might be damaged by abrasion or the like.

SUMMARY OF THE INVENTION

According to an aspect of the present invention, a belt unit includes an endless belt configured to be movably supported by a plurality of support rollers, a steering roller included in the plurality of support rollers and configured to correct a position of the belt in a width-wise direction by being rotated about a steering axis line crossing a rotary axis direction of the steering roller and inclined, a supporting member configured to support the steering roller in such a manner that the steering roller is rotatable about the steering axis line, a frame configured to support the supporting member, a pair of non-rotating members disposed at both end portions of the steering roller in the rotary axis direction, and configured to generate force for rotating the steering roller about the steering axis line with frictional force produced by friction on an inner circumference surface of the belt, and a restricting portion configured to enable the steering roller to incline by a maximum possible amount for correcting the position of the belt in the width-wise direction and to restrict inclination exceeding the maximum possible amount.

An image forming apparatus according to another aspect of the present invention includes the belt unit according to the above-described aspect, and a toner image forming unit configured to form a toner image on the belt or on a recording medium conveyed by the belt.

Further features of the present invention will become apparent from the following description of exemplary embodiments with reference to the attached drawings.

DESCRIPTION OF THE EMBODIMENTS

A belt unit according to the present invention and an image forming apparatus including the belt unit are described below in detail with reference to the drawings.

1. Image Forming Apparatus

Figure 1:
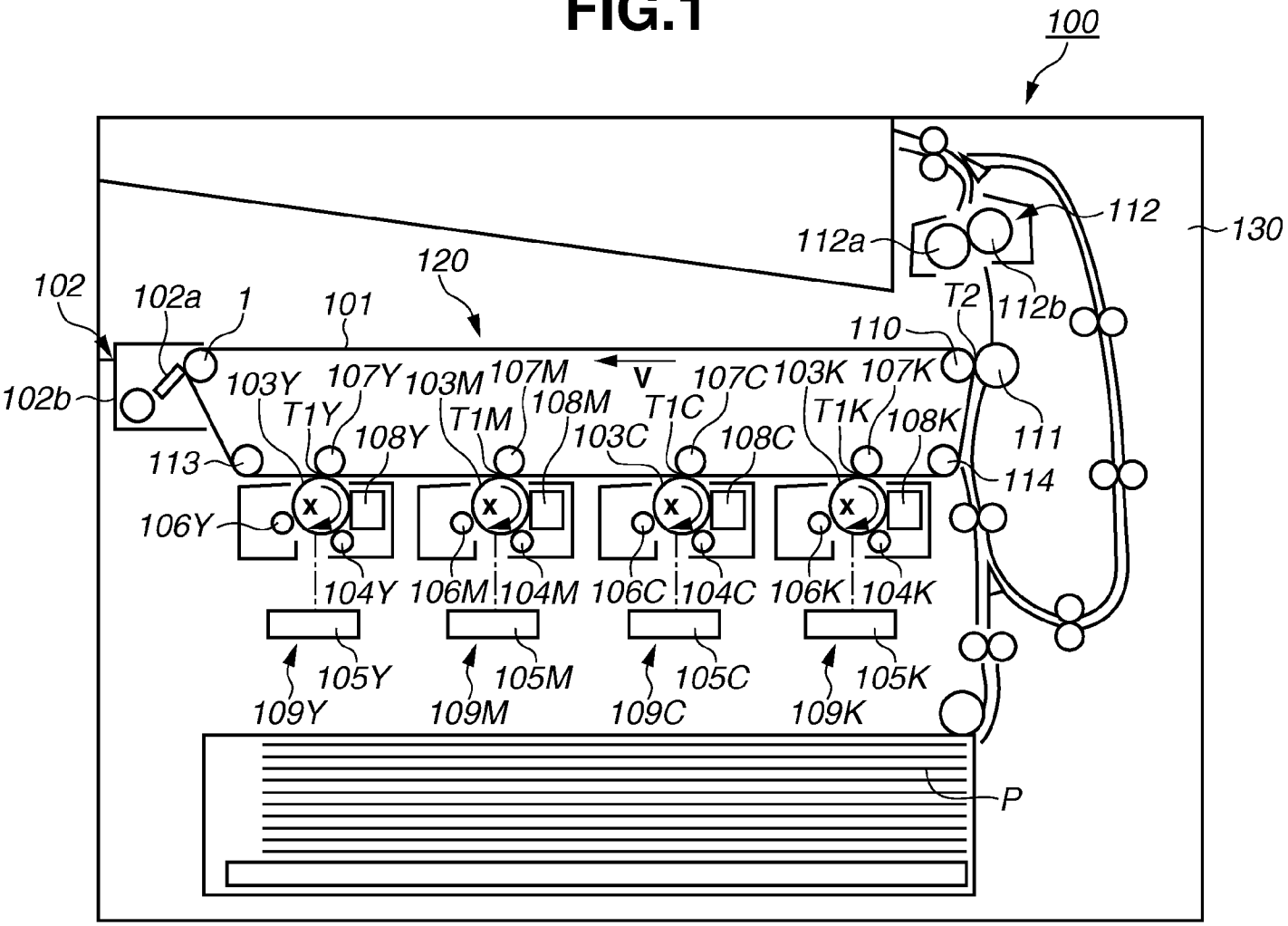
FIG. 1 is a schematic configuration diagram of an image forming apparatus.

A first exemplary embodiment is described. FIG. 1 is a schematic configuration view of an image forming apparatus 100 according to the present exemplary embodiment. The image forming apparatus 100 is a tandem printer employing an intermediate transfer method, and can form a full color image through an electrophotographic method. The image forming apparatus 100 forms an image on a recording medium P such as a recording sheet in accordance with an image signal transmitted from a computer or the like (not illustrated).

The image forming apparatus 100 includes first to fourth image forming units 109Y, 109M, 109C, and 109K as a plurality of image forming units (stations). The first to the fourth image forming units 109Y, 109M, 109C, and 109K each form an image with toner of a corresponding one of colors of yellow (Y), magenta (M), cyan (C), and black (K). In the present exemplary embodiment, the image forming units 109Y, 109M, 109C, and 109K are substantially the same in configuration and operation except for the toner color to be used. Thus, the image forming units 109Y, 109M, 109C, and 109K are collectively described with the signs Y, M, C, and K in the end indicating the color to be used omitted, when the units need not to be distinguished from each other.

The image forming unit 109 serving as a toner image forming unit, includes a drum-shaped (cylindrical) photosensitive member (photosensitive drum) 103 as an image-bearing member. The following process devices, which are components of the image forming unit 109, are disposed around the photosensitive member 103. First of all, a charging roller 104 serving as a roller-shaped charging member that is a charging unit is disposed. Next, an exposing device 105 serving as an exposing unit is disposed. Next, a developing device 106 serving as a developing unit is disposed. Next, a primary transfer roller 107 serving as a roller-shaped primary transfer member that is a primary transfer unit is disposed. Next, a photosensitive member cleaner 108 serving as a photosensitive member cleaning unit is disposed.

A surface of the photosensitive member 103, rotating in a direction indicated by an arrow X in the figure, is uniquely charged by the charging roller 104. The charged surface of the photosensitive member 103 is exposed with the exposing device 105 driven based on an input image information signal. Thus, an electrostatic latent image (electrostatic image) is formed on the photosensitive member 103. The electrostatic latent image formed on the photosensitive member 103, is developed by the developing device 106 with toner serving as a developer. Thus, a toner image is formed on the photosensitive member 103.

An intermediate transfer belt 101 formed of a movable endless belt (belt member) that serves as an intermediate transfer member, is disposed to face the photosensitive members 103 of the image forming units 109. The intermediate transfer belt 101 is wound around and supported by a driving roller 110, a steering roller 1, an upstream roller 113, and a downstream roller 114, which are a plurality of support rollers. The intermediate transfer belt 101 is rotated, in a direction indicated by an arrow V in the figure (circulating movement), by the driving roller 110 being drivingly rotated. Each primary transfer roller 107 is disposed at positions, on an inner circumference surface (back surface) of the intermediate transfer belt 101, facing the corresponding one of the photosensitive members 103. The primary transfer roller 107 is pressed (biased) toward the photosensitive member 103 with the intermediate transfer belt 101 in between. Thus, a primary transfer portion (primary transfer nip portion) T1 is formed at a portion where the photosensitive member 103 comes into contact with the intermediate transfer belt 101. A secondary transfer outer roller 111 serving as a secondary transfer unit having a roller shape, is disposed, on a side of an outer circumference surface (front surface) of the intermediate transfer belt 101, at a position facing the driving roller 110. The secondary transfer outer roller 111 is pressed (biased) toward the driving roller (also serving as a secondary transfer inner roller) 110 with the intermediate transfer belt 101 in between. Thus, a secondary transfer portion (secondary transfer nip portion) T2 is formed at a portion where the secondary transfer outer roller 111 comes into contact with the intermediate transfer belt 101. A belt cleaner 102 serving as an intermediate transfer member cleaning unit, is disposed at a position, on an outer circumference surface side of the intermediate transfer belt 101, facing the steering roller 1. The support rollers for the intermediate transfer belt 101, except for the driving roller 110, are driven to be rotated by the rotation of the intermediate transfer belt 101.

The toner image formed on the photosensitive member 103 is transferred onto the intermediate transfer belt 101 at the primary transfer portion T1, with electrostatic load bias and predetermined pressing force provided by the primary transfer roller 107 (primary transfer). Toner (primary transfer remaining toner) remaining on the photosensitive member 103 after the primary transfer is removed and collected from the photosensitive member 103 by the photosensitive member cleaner 108. Then, the photosensitive member 103 is used for forming the next image.

For example, when a full color image is formed, toner images of different colors are sequentially laid on top of the other on the intermediate transfer belt 101 at the primary transfer portions T1 of the four image forming units 109. Thus, a multiplexed toner image, for the full color image, is formed on the intermediate transfer belt 101. The number of colors, which is four in the present exemplary embodiment, is not limited to four and the arrangement of the colors is not limited to the one described above. The image forming process for each color in parallel processing by the image forming units 109 is performed at a timing at which the toner image is laid on the toner image of the upstream color that has been primarily transferred onto the intermediate transfer belt 101. As a result, the multiplexed toner image for the full color image is formed on the intermediate transfer belt 101 and then is conveyed to the secondary transfer portion T2.

The predetermined pressing force and the electrostatic load bias are applied to the toner image formed on the intermediate transfer belt 101, at the secondary transfer portion T2. Thus, the toner image is transferred onto the recording medium P (secondary transfer). The recording medium P, on which the toner image has been transferred, is conveyed to a fixing device 112. In the present exemplary embodiment, the fixing device 112, which may employ various configurations and methods, applies a predetermined pressing force and heat in a fixing nip portion formed by a fixing roller 112*a* and a pressing roller 112*b* facing each other. Thus, the toner image is melted and fixed on the recording medium P.

Toner (secondary transfer remaining toner) remaining on the intermediate transfer belt 101 after the secondary transfer is removed and collected by the belt cleaner 102 from the intermediate transfer belt 101. Then, the intermediate transfer belt 101 is used for forming the next image. In the present exemplary embodiment, the belt cleaner 102 includes, as a cleaning member, a cleaning blade 102*a* formed of a urethane rubber plate member. The cleaning blade 102*a* is disposed at a position facing the steering roller 1 with the intermediate transfer belt 101 in between. The cleaning blade 102*a* is disposed while extending in a counter direction relative to a conveyance direction (rotating direction) of the intermediate transfer belt 101 and being in contact with the intermediate transfer belt 101. The toner scraped off from the intermediate transfer belt 101 by the cleaning blade 102*a* is collected in a cleaner container 102*b*. The belt cleaner 102 is held by a mechanism (not illustrated) in such a manner as to integrally rotate (incline or turn) with the steering roller 1 about a steering axis line J (FIG. 3) described later. Thus, the belt cleaner 102 can collect the secondary transfer remaining toner while maintaining a contact state between the intermediate transfer belt 101 and the cleaning blade 102*a*, even when the steering roller 1 is inclined.

In the present exemplary embodiment, the cleaning blade 102*a* has the following settings. Specifically, a setting angle is 25°, abutment pressure is 30 gf/cm, the hardness of the urethane rubber is JIS-A hardness of 75 degrees, and the thickness of the urethane rubber is 2 mm. However, the settings are not limited to these. The setting angle is represented by an angle between a tangential direction of the intermediate transfer belt 101 at the portion to be in contact with the cleaning blade 102*a* and a surface of the cleaning blade 102*a* facing the intermediate transfer belt 101.

2. Intermediate Transfer Belt

Next, the intermediate transfer belt 101 will be described. The intermediate transfer belt 101 is a belt member that is driven for conveyance in the direction indicated by the arrow V in FIG. 1. The intermediate transfer belt 101 is stretched among the driving roller 110 serving as a driving member, the steering roller 1 serving as a belt deviation control member, the upstream roller 113, and the downstream roller 114 which are a plurality of support rollers. In the present exemplary embodiment, the driving roller 110 also has a function as the secondary transfer inner roller, which is a counterpart of the secondary transfer outer roller 111. In the present exemplary embodiment, the steering roller 1 also has a function of a tension roller that applies predetermined tension to the intermediate transfer belt 101. The steering roller (tension roller) 1 is biased by a tension spring (described below) serving as a biasing unit in a direction to move the intermediate transfer belt 101 from an inner circumference side to an outer circumference side. The number of support rollers for the intermediate transfer belt 101 is not limited to that in the present exemplary embodiment. For example, the driving roller and the secondary transfer inner roller may be separately provided, and the steering roller and the tension roller may be separately provided.

A material of the intermediate transfer belt 101 is, preferably, a relatively rigid resin such as polyvinylidene difluoride (PVDF), polyamide, polyimide, polyethylene terephthalate (PET), and polycarbonate, so that the belt is prevented from wrinkling while being drivingly rotated. When the intermediate transfer belt 101 is too thin, a sufficient durability might be unachievable due to abrasion. On the other hand, when the intermediate transfer belt 101 is too thick, the intermediate transfer belt 101 might fail to appropriately curve at the driving roller 110, the steering roller 1, the upstream roller 113, and the downstream roller 114, and thus may be recessed or bent. Thus, the thickness of the intermediate transfer belt 101 is preferably in a range from 0.02 mm to 0.50 mm. In the present exemplary embodiment, the intermediate transfer belt 101 is a resin belt with a polyimide base layer, and has a tensile elastic modulus E of 18000 N/cm$^2$ and a film thickness of 0.08 mm.

In the present exemplary embodiment, the intermediate transfer belt 101, the support rollers for the intermediate transfer belt 101, the primary transfer rollers 107Y to 107K, the belt cleaner 102, and supporting units for these components integrally form a belt unit 120. The belt unit 120 includes, as the supporting units, a frame 10 (FIG. 3) that supports the driving roller 110, the upstream roller 113, the downstream roller 114, the primary transfer rollers 107Y to 107K, and the like and a supporting base 9 serving as a supporting unit that supports the steering roller 1 and the like. The supporting base 9 is rotatably coupled to the frame 10 and forms a steering mechanism 11 described later. More specifically, the frame 10 supports at least one of the plurality of support rollers except for the steering roller 1, and supports the supporting base 9 described below in detail. The belt unit 120 is detachably attached to an apparatus main body 130 of the image forming apparatus 100. The belt unit 120 is detached from the apparatus main body 130 when the intermediate transfer belt 101 is replaced.

3. Separation Mode

Figure 2:
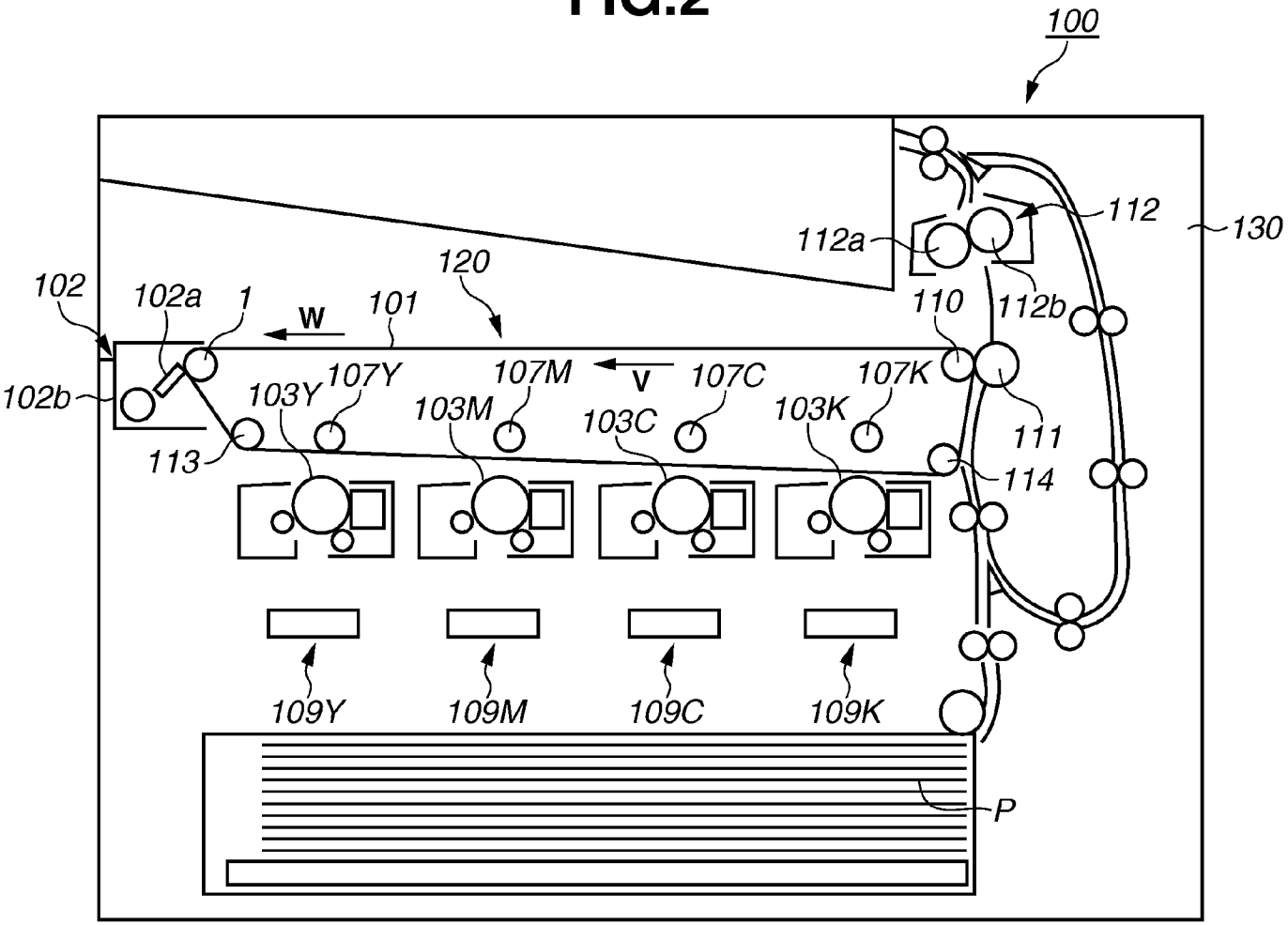
FIG. 2 is a schematic configuration diagram of the image forming apparatus in a separation mode.

Next, a separation mode will be described. FIG. 2 is a schematic configuration diagram of the image forming apparatus 100 according to the present exemplary embodiment in a separation mode.

The separation mode is a mode in which the intermediate transfer belt 101 and the photosensitive member 103 are separated from each other as illustrated in FIG. 2 when the image forming operation is not performed, to achieve a longer service life of the photosensitive member 103 for example. During the separation mode, the steering roller 1, also serving as the tension roller, moves in a direction indicated by an arrow W in the figure (tension direction), so that an extra length produced in the intermediate transfer belt 101 is absorbed. The extra length of the intermediate transfer belt 101 directly relates to a larger operation length of the tension spring. Thus, the tension applied to the intermediate transfer belt 101 is lower than that during an image forming operation illustrated in FIG. 1.

The image forming apparatus 100 includes a separating and contacting mechanism (not illustrated) that switches the intermediate transfer belt 101 to a first position in contact with the photosensitive member 103 and a second position separated from the photosensitive member 103, by moving the upstream roller 113 and the primary transfer rollers 107Y to 107K in an upper and lower direction in the figure.

In the present exemplary embodiment, the belt unit 120 is attached to and detached from the apparatus main body 130 in the following example of the separation mode. Specifically, the primary transfer rollers 107 and the intermediate transfer belt 101 are separated from the photosensitive members 103 at the positions of all the image forming units 109 (FIG. 2).

In another example of the separation mode in the present exemplary embodiment, an image can be formed with a single color of black in a black monochrome mode. In the black monochrome mode, the primary transfer rollers 107 and the intermediate transfer belt 101 are separated from the photosensitive members 103 at the positions of the first, the second, and the third image forming units 109Y, 109M, and 109C. On the other hand, in the black monochrome mode, the primary transfer roller 107 is in contact with the photosensitive member 103 with the intermediate transfer belt 101 in between at the position of the fourth image forming unit 109K (not elaborated in the drawings). The intermediate transfer belt 101 is driven in this state. Also in this case, the tension applied to the intermediate transfer belt 101 is smaller than that in the full color mode illustrated in FIG. 1, in which the primary transfer rollers 107 are in contact with the photosensitive members 103 with the intermediate transfer belt 101 in between at the positions of all the image forming units 109, as in the case illustrated in FIG. 2.

4. Steering Configuration of Intermediate Transfer Belt

Figure 3:
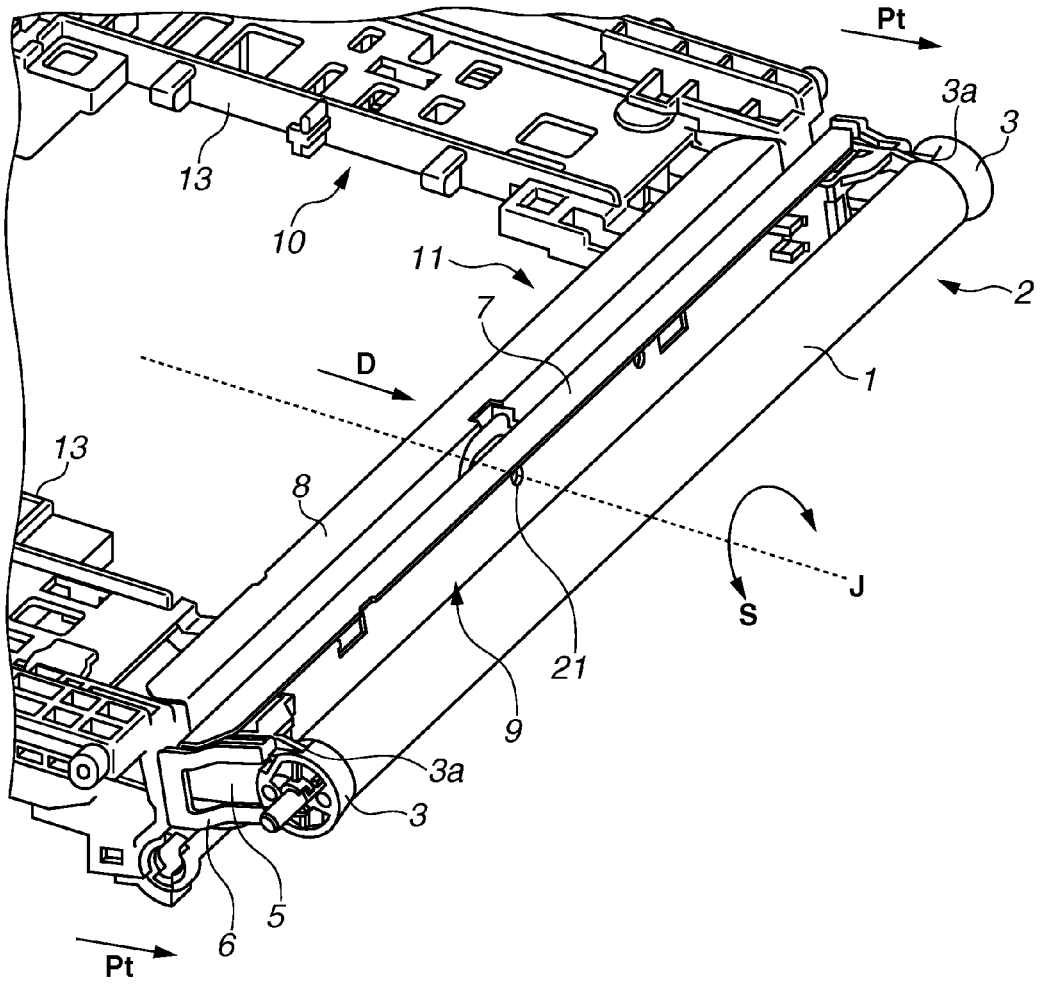
FIG. 3 is a perspective view of a steering mechanism.

FIG. 3 is a perspective view of the steering mechanism (steering device) 11 serving as a steering unit employing a belt auto alignment method according to the present exemplary embodiment. The steering mechanism 11 corrects (aligns or offsets) belt deviation with the belt auto alignment method. The belt deviation is deviation (shifting) from a target position in a width-wise direction (substantially orthogonal to the conveyance direction) of the intermediate transfer belt 101.

The steering mechanism 11 includes the steering roller 1 that is rotatably provided (can incline or turn) to correct the belt deviation of the intermediate transfer belt 101. The steering roller 1, which is one of the plurality of support rollers, corrects the deviation (belt deviation) of the position of the intermediate transfer belt 101 in the width-wise direction. The steering mechanism 11 includes sliding ring portions 3 serving as sliding portions (friction portions) disposed at both end portions of the steering roller 1 in a rotary axis direction. The steering roller 1 and the sliding ring portions 3 are coaxially arranged to form a steering member 2. The sliding ring portion 3 has a slide groove portion 3*a* fit to a side supporting member 6, and is biased by a tension spring 5 (compression spring) serving as an elastic member to slide in a direction indicated by an arrow $P_T$ in the figure (direction from the inner circumference surface side to the outer circumference surface side of the intermediate transfer belt 101). Thus, the steering roller 1 also functions as the tension roller that applies the tension to the inner circumference surface of the intermediate transfer belt 101.

The side supporting member 6 and a rotating plate 7 form the supporting base 9 serving as a supporting member that supports the steering roller 1 and the sliding ring portions 3. The rotating plate 7 is supported by a frame stay 8 via a steering shaft 21 as a rotary shaft in such a manner as to be rotatable about a steering axis line (variable supporting point) J in a direction indicated by an arrow S in the figure at a center portion in a longitudinal direction. As described above, the supporting base 9 rotatably supports the steering roller 1 in such a manner as to make the steering roller 1 rotatable about the steering axis line J at the center portion in the rotary axis direction.

The frame stay 8 is a member forming the frame (casing) 10 of the belt unit 120. The frame 10 includes the driving roller 110, the upstream roller 113, the downstream roller 114, and side plates 13 disposed at both end portions on front and rear sides in the rotary axis direction of the primary transfer rollers 107Y to 107K. The frame stay 8 is disposed across the side plates 13.

Figure 4:
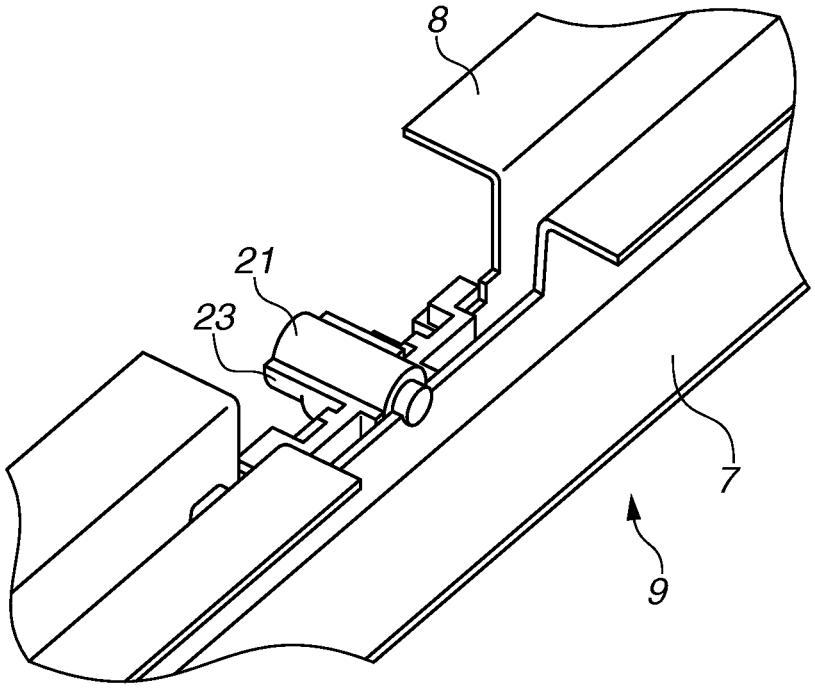
FIG. 4 is a partially cutout enlarged perspective view of the steering mechanism.

FIG. 4 is a partially notched perspective view illustrating the configuration of a rotation center portion of the supporting base 9 in detail. The steering shaft 21 serving as the rotary shaft, is integrally fastened to a center portion of the rotating plate 7 in the longitudinal direction through caulking. The steering shaft 21 is inserted in a steering shaft bearing 23 formed in the frame stay 8, and thus is rotatably supported.

Figure 5A:
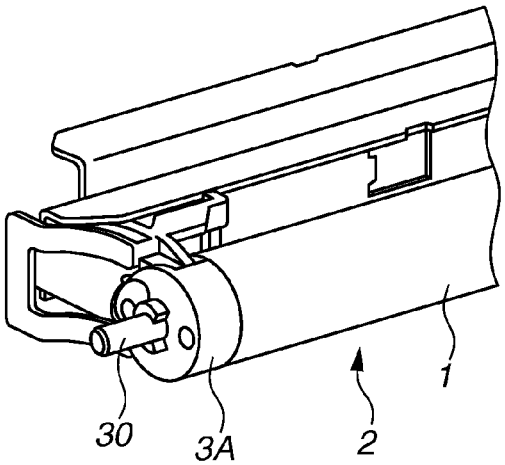
FIGS. 5A and 5B are perspective views of an end portion of the steering mechanism.
Figure 5B:
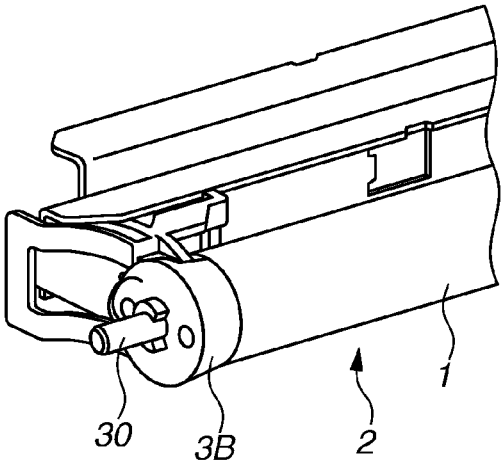

FIG. 5 is a perspective view illustrating a portion around the end portion of the steering roller 1 in the rotary axis direction in detail. As illustrated in FIG. 5A, the sliding ring portion 3 may be of a straight type 3A with a uniform outer diameter in the rotary axis direction of the steering roller 1. As illustrated in FIG. 5B, the sliding ring portion 3 may be of a tapered type 3B with an outer diameter continuously increasing toward the outer side in the rotary axis direction of the steering roller 1. A steering roller shaft 30 is fit in and supported in the sliding ring portion 3 (3A or 3B) in such a manner as to be driven by the steering roller 1 to rotate. When the intermediate transfer belt 101 travels, the steering roller is driven to be rotated without sliding on the inner circumference surface of the intermediate transfer belt 101, whereas the sliding ring portions 3 at both ends slide on the intermediate transfer belt 101 without being driven to be rotated by the intermediate transfer belt 101. In the present exemplary embodiment, the steering roller 1 starts the steering when a contact area between the sliding ring portion 3 and the intermediate transfer belt 101 increases to be equal to or larger than a predetermined area in the rotary axis direction of the steering roller 1. Thus, the sliding ring portions 3 are disposed adjacent to both end portions of the steering roller 1 in the rotary axis direction, and can rotate together with the steering roller 1 about the steering axis line J. The sliding ring portion 3 generates force for rotating the steering roller 1 about the steering axis line J while sliding on the inner circumference surface of the intermediate transfer belt 101.

In the present exemplary embodiment, the sliding ring portion 3 is fixed in such a manner as not to be rotatable in the rotation direction of the steering roller 1. Alternatively, the sliding ring portion 3 may be rotatable. However, in such a case, the steering can be performed only when the torque required for rotating the sliding ring portion 3 in the rotation direction of the intermediate transfer belt 101 becomes larger than the torque required for rotating the steering roller 1 in the same direction.

Figure 6A:
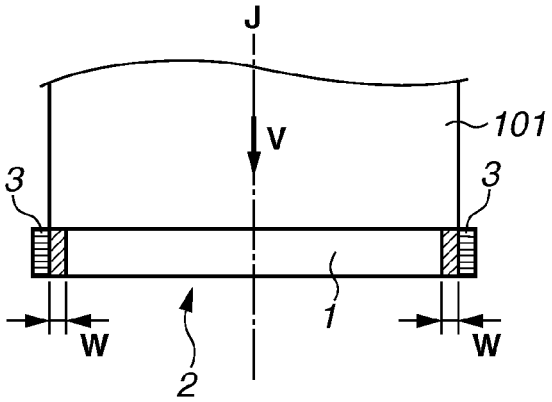
FIGS. 6A and 6B are schematic diagrams illustrating overlapping widths between a belt and a sliding ring portion.
Figure 6B:
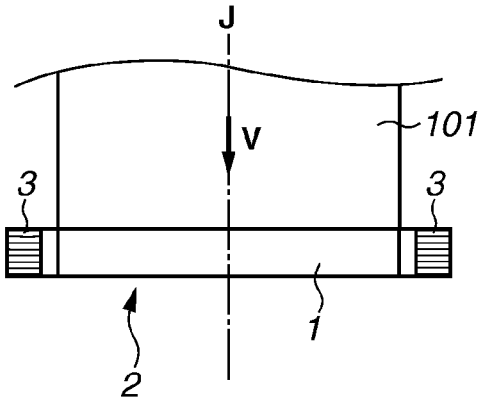

In the present exemplary embodiment, the width of the intermediate transfer belt 101 in the rotary axis direction of the steering roller 1 is larger than the width of the steering roller 1 but is smaller than the width between both ends of the sliding ring portions 3 (steering roller 1+sliding ring portions 3 at both ends). Thus, in an ideal constant alignment state, an overlapping width w (hatched portion in the figure) between the intermediate transfer belt 101 and the sliding ring portion 3 is the same between both end portions as illustrated in FIG. 6A. In this state, even if the belt deviation occurs, the intermediate transfer belt 101 slides with the overlapping width w ensured at one of the sliding ring portions 3 without fail. Thus, in this state, while the intermediate transfer belt 101 is moving, at least one of the sliding ring portions 3 constantly slides on the intermediate transfer belt 101. The width of the intermediate transfer belt 101 smaller than that of the steering roller 1 as illustrated in FIG. 6B is likely to result in a sudden alignment operation because the supporting base 9 cannot rotate without the overlapping width w of the sliding ring portion 3 even when the belt deviation occurs. As described above, it is not impossible in principle to perform belt auto alignment with friction force balance even with the overlapping width w as illustrated in FIG. 6B. Still, with the overlapping width w as illustrated in FIG. 6A, the balance difference can be constantly detected and thus a more frequent alignment operation can be performed. Thus, a steering angle is less likely to largely change over time. For example, in FIG. 6A, when the intermediate transfer belt 101 shifts to the left, the overlapping width w between the left sliding ring portion 3 and the intermediate transfer belt 101 becomes larger than that on the right side. Thus, the steering roller 1 rotates in a counter clockwise direction so that the intermediate transfer belt 101 is moved toward the right side. When the intermediate transfer belt 101 shifts to the right in the state illustrated in FIG. 6A, the operation opposite to that described above is performed.

In the present exemplary embodiment, the width of the cleaning blade 102*a* of the intermediate transfer belt cleaner 102 is smaller than that of the steering roller 1 in the rotary axis direction of the steering roller 1.

A coefficient of static friction μs of the sliding ring portion 3 will be described. When the sliding ring portion 3 has a tapered shape as illustrated in FIG. 5B, preferably the coefficient of static friction $\mu_s$ of the surface is about 0.3 and the taper angle Φ is preferably about 10°. The coefficient of static friction $\mu_s$ of the surface of the sliding ring portion 3 is assumed to be larger than a coefficient of static friction $\mu_{STR}$ of the surface of the steering roller 1. In the present exemplary embodiment, a slidable resin material such as polyacetal (POM) is used as a material of the sliding ring portion 3. Furthermore, the intermediate transfer belt 101 is conductive to be free of electrostatic problem due to frictional charging with the intermediate transfer belt 101. When the sliding ring portion 3 has the straight shape as illustrated in FIG. 5A, the coefficient of static friction $\mu_s$ of the surface is preferably set to be larger than that in the case of the tapered shape, and thus is about 0.6.

Next, the coefficient of static friction $\mu_{STR}$ of the steering roller 1 will be described. In the present exemplary embodiment, aluminum is used as a material of the steering roller 1, and thus the surface coefficient of static friction $\mu_{STR}$ is about 0.1. Alternatively, any other material can be used as long as the coefficient of static friction $\mu_{STR}$ of the surface of the steering roller 1 is smaller than the coefficient of static friction $\mu_s$ of the surface of the sliding ring portion 3.

Here, the coefficients of friction of the sliding ring portion 3 and the steering roller 1 are measured with a method of JIS K7125 plastics-film and sheeting-determination. More specifically, the measurement is performed with a sheet on the inner circumference surface of the belt member, which is a polyimide sheet, which is the sheet on the inner circumference surface sheet of the intermediate transfer belt in the present exemplary embodiment, as a test piece.

5. Inclination Restricting Configuration for Steering Mechanism

Figure 7A:
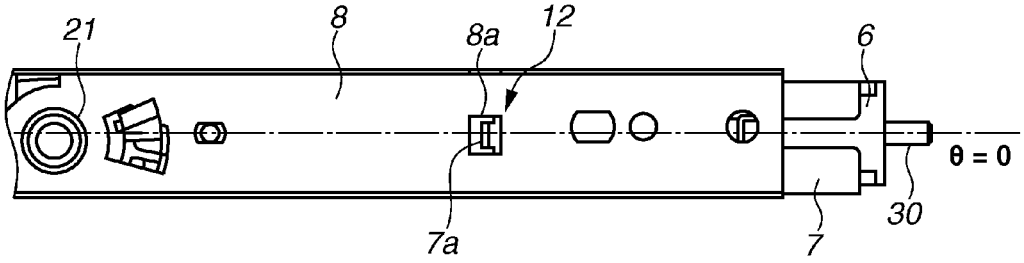
FIGS. 7A and 7B are diagrams of the steering mechanism in FIG. 3 as viewed in a direction indicated by an arrow D.
Figure 7B:
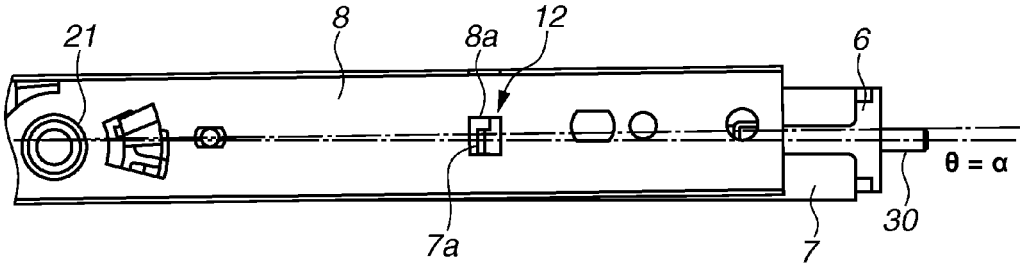

Next, an inclination restriction configuration for the steering mechanism 11 is described. FIGS. 7A and 7B are side views of the steering mechanism 11 viewed in a direction indicated by an arrow D in FIG. 3 (direction from the inner side to the outer side of the frame 10 along the steering axis line J).

Figure 8:
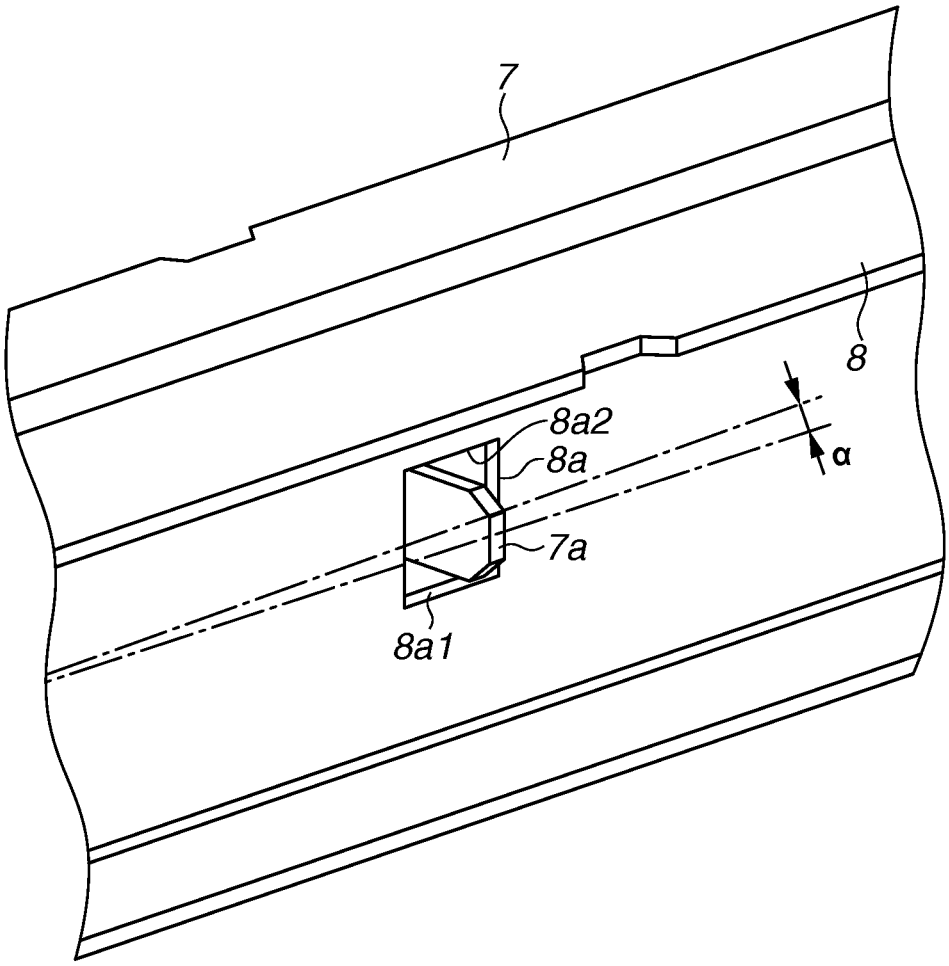
FIG. 8 is an enlarged perspective view of a restricting portion.
Figure 9:
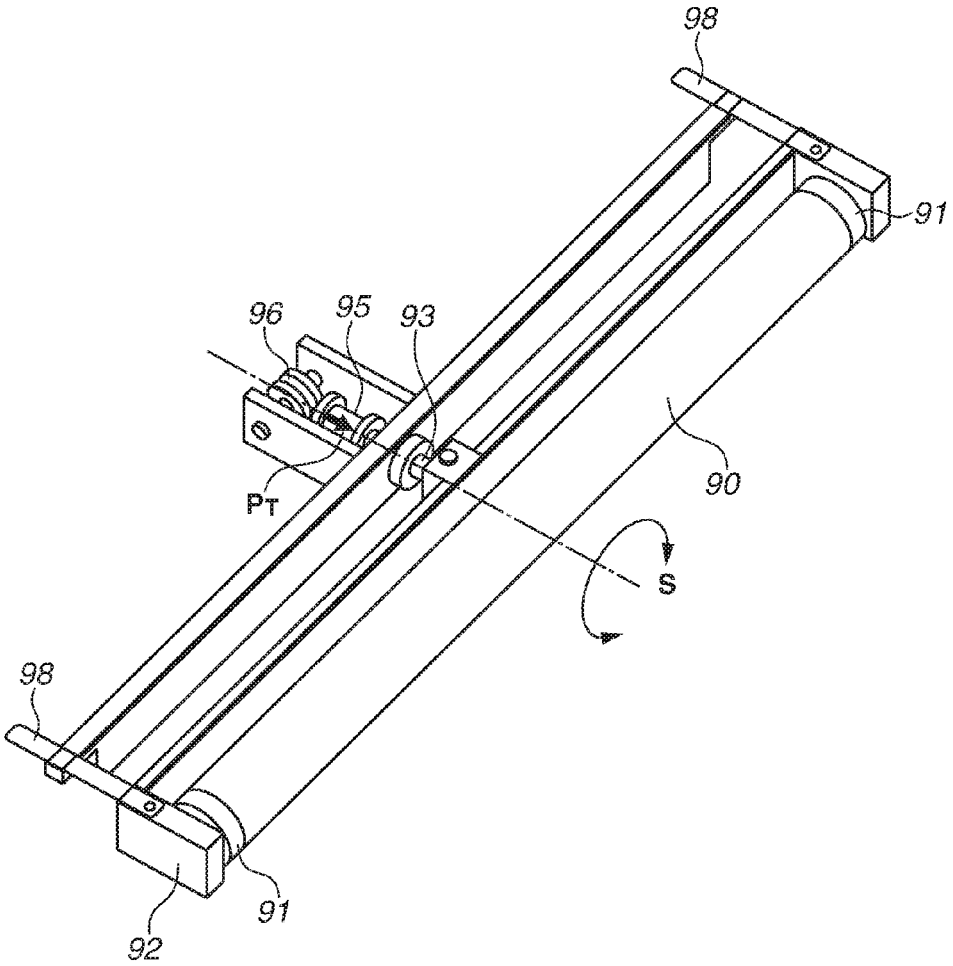
FIG. 9 is a perspective view of belt auto alignment according to a conventional example.

As illustrated in FIGS. 7A and 7B, a protrusion portion 7*a* serving as a first engagement portion (supporting member side engagement portion), formed by bending up the rotating plate 7, is inserted in a square hole portion 8*a* serving as a second engagement portion (frame side engagement portion) formed in the frame stay 8. A restricting portion 12 for restricting the inclination of the steering mechanism 11 is formed of the protrusion portion 7*a* and the square hole portion 8*a*. FIG. 8 is a perspective view illustrating the restricting portion 12, formed of the protrusion portion 7*a* and the square hole portion 8*a*, in detail. In the present exemplary embodiment, the protrusion portion 7*a* and the square hole portion 8*a* are disposed at corresponding positions (substantially middle portion) between the steering shaft 21 (steering axis line J) and one end portion of the frame stay 8 in the longitudinal direction. The protrusion portion 7*a* of the rotating plate 7 extends toward the frame stay 8 and is inserted in the square hole portion 8*a*. The restricting portion 12 enables the steering roller 1 to rotate about the steering axis line J for correcting the deviation of the position of the intermediate transfer belt 101 in the width-wise direction, while restricting the inclination of the steering roller 1 due to the rotation.

When an inclination angle θ (°) is 0 in a state where the rotary axis of the steering roller 1 is substantially horizontal and $-\alpha<\theta<\alpha$ (with the clockwise direction in FIG. 7A being the positive angle direction) hold true, the protrusion portion 7*a* is not in contact with the square hole portion 8*a*. Thus, the steering roller 1 can rotate within this range (referred to as "steering restricting range"). When $\theta=\alpha$, as shown in FIG. 7B, or $-\alpha$ holds true, the protrusion portion 7*a* comes into contact (engages) with a contact portion 8*a*1 or 8*a*2 of an inner side edge portion of the square hole portion 8*a*, and thus the steering roller 1 is prevented from inclining to be in a range of $\theta<-\alpha$ or $\theta>\alpha$.

Here, in the present exemplary embodiment, the angle α (°) defining the steering restricting range is a range obtained by adding 0.2° as a predetermined margin angle to a maximum possible inclination amount of the steering roller 1 required for the belt auto alignment. Thus, the inclination of the steering roller 1 can be restricted without affecting the belt auto alignment.

The inclination of the steering mechanism 11 can be regulated within a predetermined range when the belt unit 120 is attached to or detached from the apparatus main body 130 in a state where a low tension is applied to the intermediate transfer belt 1 as an example of the separation mode described above. Thus, the steering mechanism 11 can be prevented from largely inclining and coming into contact with peripheral members such as the photosensitive member 103. An advantageous effect can also be obtained when the intermediate transfer belt 101 is driven with a low tension applied to the intermediate transfer belt 101 in the black monochrome mode as another example of the separation mode described above. Thus, also in these cases, the belt auto alignment can be performed and the steering mechanism 11 can be prevented from largely inclining and coming into contact with peripheral members such as the photosensitive member 103. As described above, in the present exemplary embodiment, the intermediate transfer belt 101 is switched between a first state (in the full color image forming and the like) of receiving a first tension and a second state (in the separation mode and the like) of receiving a second tension smaller than the first tension. In the first state, the inclination angle θ of the steering roller 1 is within the range $-\alpha<\theta<\alpha$ but the inclination angle θ of the steering roller 1 may be $\theta=\pm\alpha$ in the second state. However, with the restricting portion 12, the inclination angle θ of the steering roller 1 is prevented from satisfying $\theta>\alpha$ or $\theta<-\alpha$ even in the second state.

In the present exemplary embodiment, the maximum possible inclination amount of the steering roller 1 required for the belt auto alignment is 1°. In the present exemplary embodiment, α is set to be 1.2°. However, the angle α defining the steering restricting range is not limited to that in the present exemplary embodiment, and can be appropriately set in accordance with the configuration of the image forming apparatus for implementing the present invention. Generally, the angle $\alpha$ is preferably 5° or smaller ($\alpha<5°$).

In the present exemplary embodiment, the hole portion as the second engagement portion is the square hole portion. The shape of the hole portion is not limited to this and may be any shape such as a circle, an oval, or other polygonal shapes. In the present exemplary embodiment, the first engagement portion is the protrusion portion and the second engagement portion is the hole portion. Alternatively, an opposite relationship may be employed in which case the first engagement portion is the hole portion and the second engagement portion is the protrusion portion. Instead of the hole portion in which the protrusion portion can be inserted to be engaged as in the present exemplary embodiment, a recess portion in which the protrusion portion can be inserted to be engaged may be employed as the first engagement portion or the second engagement portion. The shapes of the first engagement portion and the second engagement portion are not limited to the protrusion portion and the hole portion (recess portion), as long as the inclination of the steering mechanism 11 can be restricted. In the present exemplary embodiment, the first engagement portion and the second engagement portion are integrally formed with the supporting member and the frame. Alternatively, at least one of the engagement portions may be formed separately from the supporting member and/or the frame and may be fixed with an appropriate fixing unit.

As described above, in the present exemplary embodiment, the steering mechanism 11 includes the restricting portion 12 that prevents the steering mechanism 11 from inclining by an angle outside the angle range for performing the belt auto alignment. Thus, the belt auto alignment can be performed and the steering mechanism 11 can be prevented from inclining and coming into contact with peripheral members such as the photosensitive member 103 to cause damage by abrasion or the like, even when a low tension is applied to the intermediate transfer belt 101. When the belt unit 120 is attached to or detached from the apparatus main body 130 while a low tension is being applied to the intermediate transfer belt 101, the steering mechanism 11 can be prevented from inclining and coming into contact with peripheral members such as the photosensitive member 103 to cause damage by abrasion or the like.

Others

The present invention is described above based on a specific exemplary embodiment. However, the present invention is not limited to the exemplary embodiment described above.

The present invention can be applied to an image forming apparatus employing a direct transfer method known in the art in which a toner image is directly transferred onto a recording medium conveyed while being carried by a recording medium bearing member. The image forming apparatus employing the direct transfer method includes a recording medium bearing belt formed of an endless belt as the recording medium bearing member, instead of the intermediate transfer belt in the exemplary embodiment described above. Toner images formed on the photosensitive members are sequentially transferred onto the recording medium carried by the recording medium bearing member at the corresponding transfer portions. The present invention can be also applied to a belt unit including the recording medium bearing belt used in such an image forming apparatus, and provide an effect similar to that in the exemplary embodiment described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-109578, filed May 27, 2014, which is hereby incorporated by reference herein in its entirety.

What is claimed is:

1. A belt unit comprising:

an endless belt configured to be movably supported by a plurality of support rollers;

a steering roller included in the plurality of support rollers, and configured to correct a position of the belt in a width-wise direction by being rotated about a steering axis line crossing a rotary axis direction of the steering roller and inclined;

a supporting member configured to support the steering roller in such a manner that the steering roller is rotatable about the steering axis line;

a frame configured to support the supporting member;

a pair of non-rotating members disposed at both end portions of the steering roller in the rotary axis direction, and configured to generate force for rotating the steering roller about the steering axis line with frictional force produced by friction on an inner circumference surface of the belt; and a restricting portion configured to enable the steering roller to incline by a maximum possible amount for correcting the position of the belt in the width-wise direction and to restrict inclination exceeding the maximum possible amount.

2. The belt unit according to claim 1, wherein the restricting portion includes a first engagement portion formed in the supporting member and a second engagement portion formed in the frame and is able to engage with the first engagement portion.

3. The belt unit according to claim 2, wherein the first engagement portion is a protrusion portion formed in the supporting member and the second engagement portion is a hole portion or a recess portion, in which the protrusion portion is inserted, formed in the frame, or the second engagement portion is a protrusion portion formed in the frame and the first engagement portion is a hole portion or a recess portion, in which the protrusion portion is inserted, formed in the supporting member.

4. The belt unit according to claim 3, wherein the first engagement portion and the second engagement portion do not come into contact with each other when an angle $\theta$ of the inclination is within a range $-\alpha<\theta<\alpha$, and come into contact with each other when the angle $\theta$ of the inclination is $\theta=\pm\alpha$ to prevent the angle $\theta$ of the inclination from being $\theta>\alpha$ or $\theta<-\alpha$.

5. The belt unit according to claim 4, wherein the angle $\alpha$ satisfies $\alpha<5°$.

6. The belt unit according to claim 4, wherein the belt is switched between a first state in which a first tension is applied and a second state in which a second tension smaller than the first tension is applied, and wherein the angle $\theta$ of the inclination is within the range $-\alpha<\theta<\alpha$ in the first state, and is able to be $\theta=\pm\alpha$ in the second state.

7. The belt unit according to claim 6, wherein the belt unit is detachably attached to an apparatus main body of an image forming apparatus configured to form a toner image on the belt or on a recording medium conveyed by the belt, and wherein the belt is in the second state when the belt unit is attached to or detached from the apparatus main body.

8. The belt unit according to claim 6, wherein the belt is able to drive in the second state.

9. An image forming apparatus comprising:

the belt unit according to claim 1; and a toner image forming unit configured to form a toner image on the belt or on a recording medium conveyed by the belt.

* * * * *